US007373746B1

(12) United States Patent
Pettesch

(10) Patent No.: US 7,373,746 B1
(45) Date of Patent: May 20, 2008

(54) SIGN ASSEMBLY WITH MOUNTING ASSEMBLY

(75) Inventor: Martin Pettesch, Cranford, NJ (US)

(73) Assignee: Technalink, Inc., Cranford, NJ (US)

( * ) Notice: Subject to any disclaimer, the term of this patent is extended or adjusted under 35 U.S.C. 154(b) by 412 days.

(21) Appl. No.: 10/197,635

(22) Filed: Jul. 17, 2002

(51) Int. Cl.
*G09F 7/18* (2006.01)

(52) U.S. Cl. ..... 40/605; 40/606.16; 160/135

(58) Field of Classification Search ..... 40/607.1, 40/606.14, 606.15, 606.16, 607.5, 607.3; 160/135; 211/182
See application file for complete search history.

(56) References Cited

U.S. PATENT DOCUMENTS 2,790,258 A * 4/1957 Freshour ..... 40/610
3,204,689 A * 9/1965 Howell ..... 160/135
4,221,086 A * 9/1980 Berman ..... 52/65

* cited by examiner

*Primary Examiner*—Cassandra Davis
(74) *Attorney, Agent, or Firm*—Edward Dreyfus

(57) ABSTRACT

A sign assembly supported above a supporting surface includes at least one sign frame, an upstanding hinge rod assembly mounted on the supporting surface, and a hinge plate rotatably supported by the hinge rod assembly is connected to one frame side. The other frame side connects to a second plate that is supported by a pre-installed post or another hinge rod assembly. The angles of the one or more sign frames can be changed to meet installation requirements until the post mounts and/or hinge rod assemblies are fixed relative the supporting surface.

11 Claims, 7 Drawing Sheets

SIGN ASSEMBLY WITH MOUNTING ASSEMBLY

BACKGROUND OF INVENTION

The present invention relates to information and advertising signs and more particularly to a new arrangement for supporting one or more display sign assemblies that include a vertical post, installed in or on the ground, concrete, macadam, or other surface material.

One result of our societies dependence on the automobile is the growing popularity of drive-through and parking facilities for all kinds of services including convenience stores, fast food services, fueling stations, banking, etc. Designs of these facilities, by choice or by law, include many safety devices intended to avoid or reduce the consequences of automobile impact on walls, curbing, auto stop blocks, and equipment such as automatic vacuum tube canister delivery systems, gasoline dispensers, fast food ordering speaker and communications systems, etc. To avoid or reduce auto collision efforts, designers commonly install bumper guard pipes to protect facilities and equipment from impact. These guards commonly include 4 to 8 inch steel or aluminum pipe painted white or red, capped or filled with a concrete plug, and installed on or into or adjacent the driving surface and standing 3 to 4 feet above the surface. Although these guards provide some degree of impact protection, they provide poor visual protection to the contiguous facility or equipment. In addition, these standard guards provide no advertising value for the facility or services or products provided there.

Some progress and improvements have been made by the present inventor and assignee hereof in combining the U-shaped pipe guards in front of fueling dispensers with a sign assembly mounted on the center leg thereof. See U.S. patent application Ser. No. 09/333,230, filed Jun. 14, 1999 owned by the present assignee.

However, the need exits for a sign assembly that can easily and efficiently mount to a vertical pipe guard regardless of the spacing between adjacent vertical pipe guards or alternately reliably mount in stand along fashion with the same elements used to secure the sign assembly to a pipe guard.

SUMMARY OF INVENTION

The present invention satisfies the foregoing need and provides other advantages and benefits as well.

One exemplary embodiment includes a hinge-post assembly secured in or on the supporting surface for rotatably supporting one or two of oppositely facing hinge-mounts, each hinge-mount being connected to a respective side-frame. The hinge-post assembly enables the angular adjustment of the one or two sign frames supported by the hinge-post assembly so that the opposite side frames can be spaced from each other to accommodate the spacing of adjacent sign supporting pipe guard or posts.

One of the exemplary embodiment includes a post-mount for connection to a vertical post or pipe guard already installed on or pre-installed in the supporting surface. The post-mount also connects to and supports the respective vertical side frame opposite the respective hinge-mount. The post-mount can also be rotated on the post to select the proper mounting angle and sign orientation prior to securing the post-mount to the vertical post. A lateral bar or beam member extends from the hinge-mount to a post-mount or other hinge-mount connected to the opposite side frame of the respective sign frame to strengthen and stabilize the sign assembly. Another post-mount can be connected to a similar pre-installed post or a second hinge-post second hinge-mount can support the opposite side frame. The vertical locations of the post-mounts and hinge-mounts assure that the sign frame bottoms are spaced suitably above and oriented with the supporting surface.

Another exemplary embodiment includes a third sign frame having hinge-mounts connected to the outer side-frames and being supported by a third hinge-post instead of a pre-installed post. In this embodiment the three signs frames and transverse bars form a strong triangular shape in horizontal section to resist wind and impact forces. The sign frames preferably enable display boards to be quickly installed or changed by opening the front frame side channels and closing the same to secure the board edges. Elements of the present frame assemblies are simply and inexpensively made and install with ease. The hinge posts can be fitted with footings and installed with surface bolts.

It is preferred to form or weld the post-mount, lateral member, and hinge-mount into a single mounting assembly unit for ease of handling and installation.

BRIEF DESCRIPTION OF DRAWINGS

Other and further benefits and advantages of the present invention will become apparent with the following detailed description when taken in view of the appended drawings, in which.

DETAILED DESCRIPTION

Figure 1:
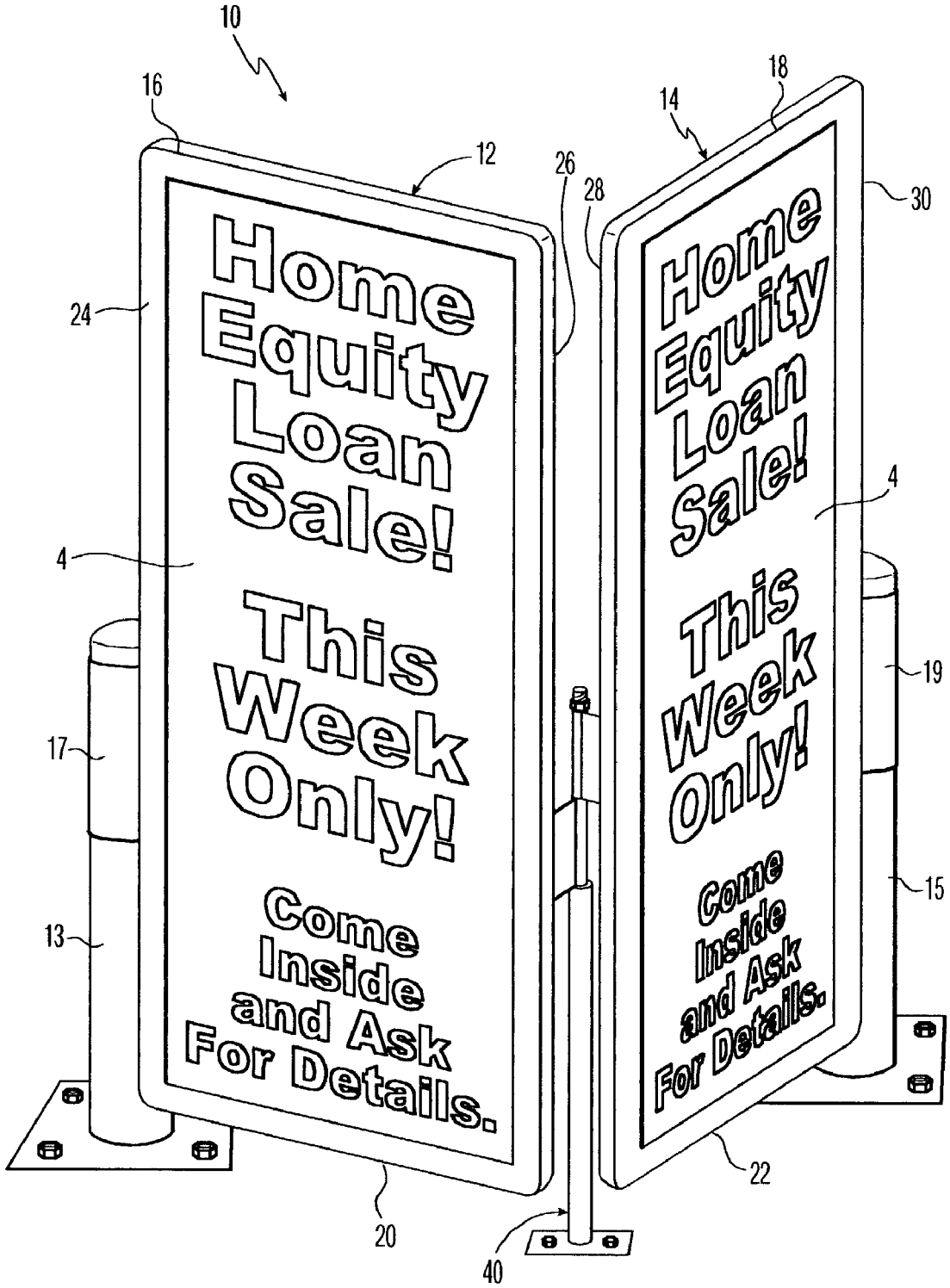
FIG. 1 is a perspective view of one exemplary dual sign assembly and two pre-installed posts according to the principles of the present invention.
Figure 2:
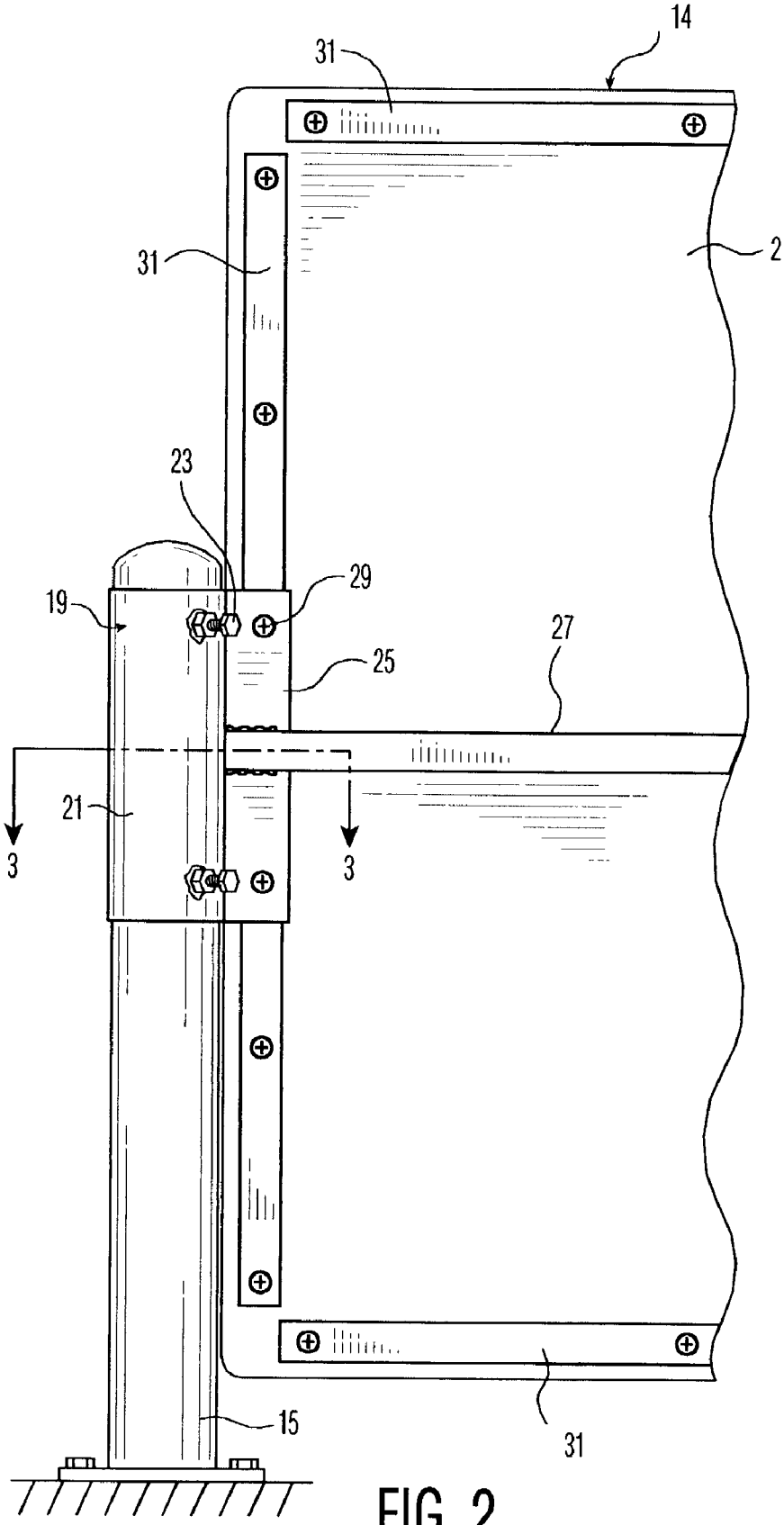
FIG. 2 is a partial rear view of post 15 and the contiguous side of sign frame 14.
Figure 3:
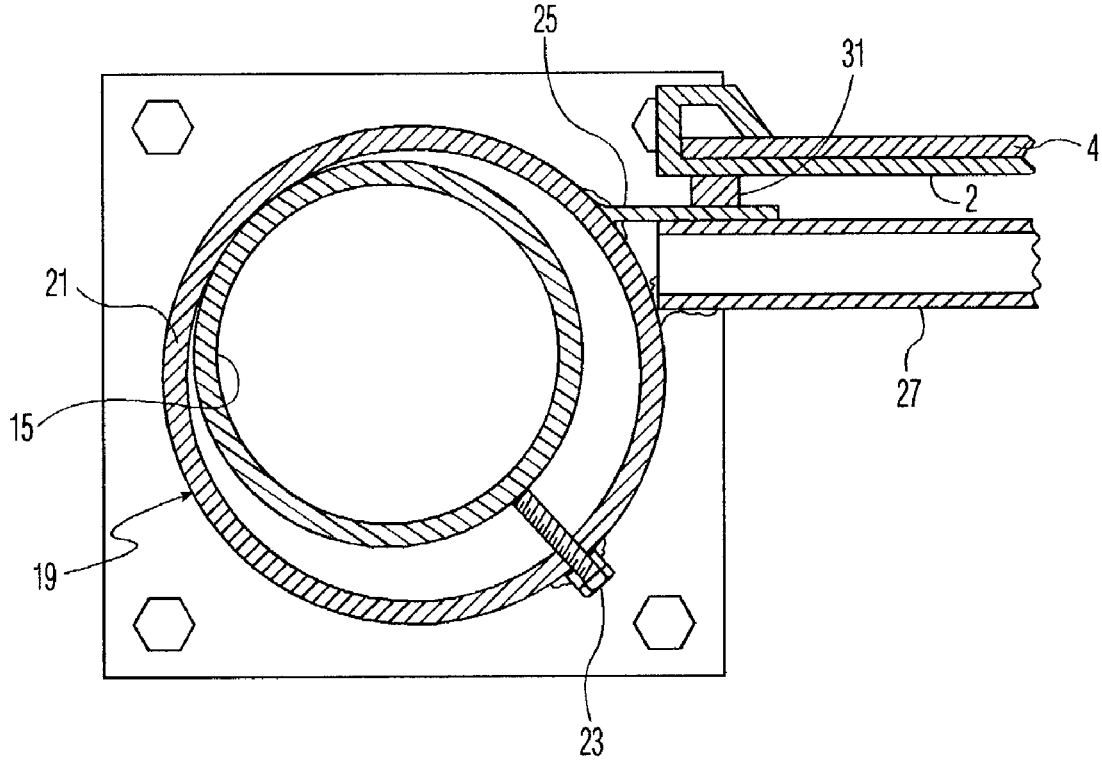
FIG. 3 is a horizontal section taken along line 3-3 of FIG. 2.
Figure 4:
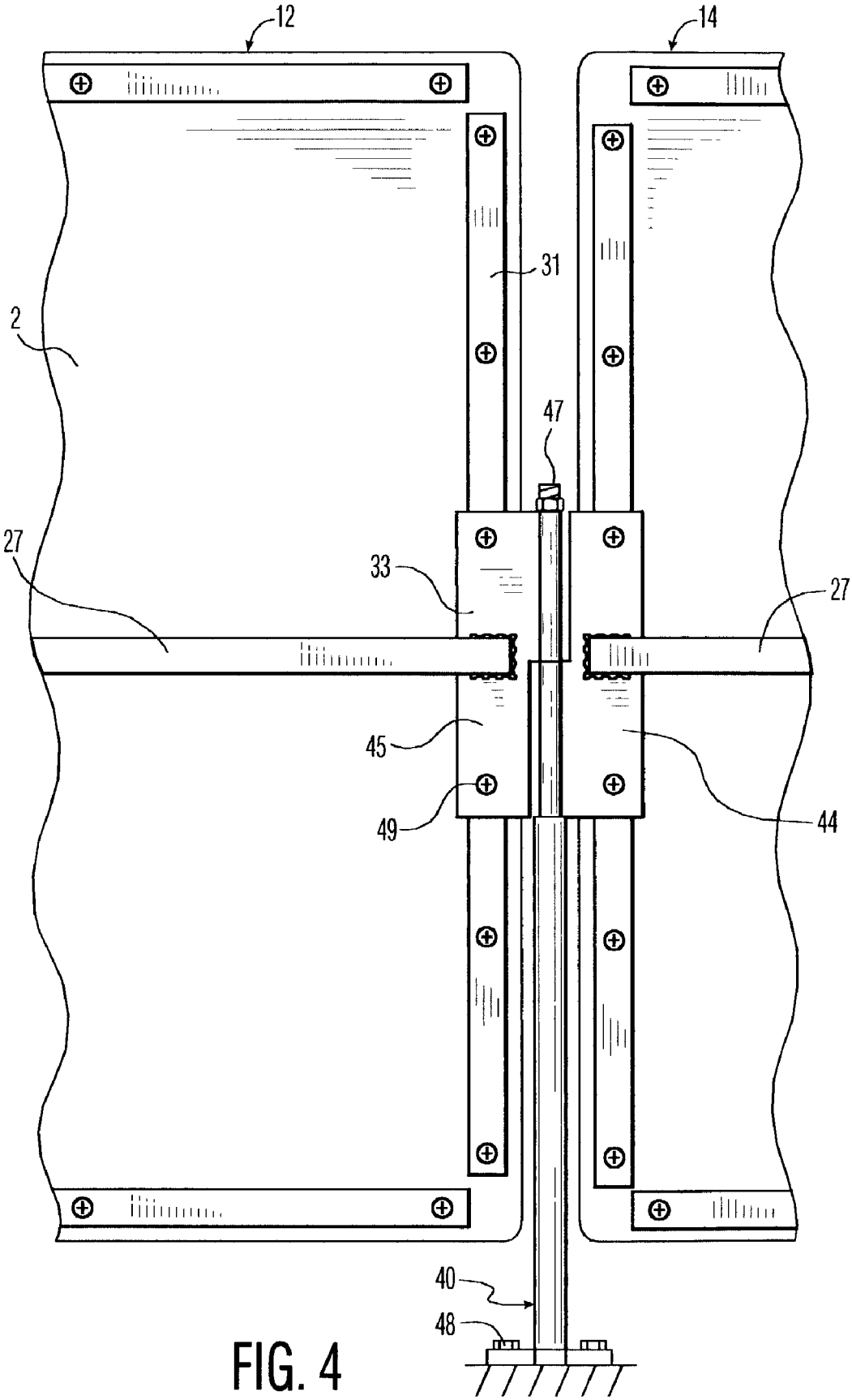
FIG. 4 is a partial rear view of the center portion of FIG. 1.
Figure 5:
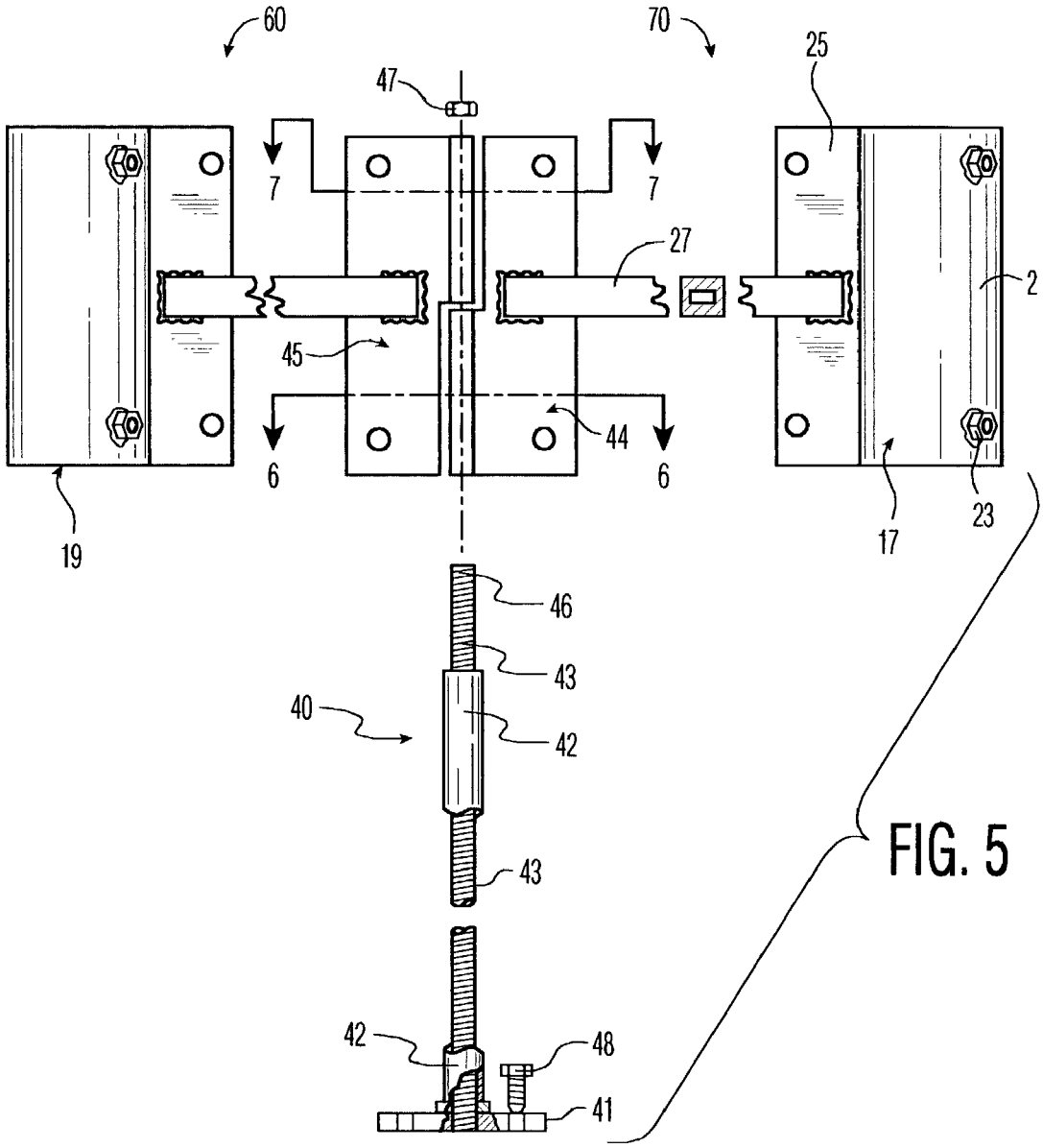
FIG. 5 is an exploded view of the hinge post assembly and mounting assemblies with tube 42 partially broken away.

With reference to FIGS. 1 to 5 one exemplary sign assembly 10 according to the principles of the present invention includes two display signs mounted to and supported by two pre-installed, generally cylindrical posts 13, 15 and a hinge-post assembly 40 more fully described below. Posts 13, 15 can be made of steel or aluminum pipe or tubing and positioned to protect drive-through banking equipment, fueling stations, fast food areas, convenience store areas and the like. Post 13, 15 can be imbedded into the supporting surface or be mounted on it by means of foot-plates 6 and bolts 8.

Assembly 10 includes sign frames 12, 14 each having a top frame 16, 18 and bottom frames 20, 22 respectively and side frames 24, 26 and 28, 30, respectively. Sign frames 12, 14 are preferably rectangular in shape and preferably have a height greater than its width, generally as shown, and includes front channels that can be opened to enable a plastic or poster display board, poster, or sign to be removed and/or placed into the frame and closed to secure the sign near its edges. Frames such as those disclosed in U.S. Pat. No. 4,145,828 are suitable for this function. A metal or plastic backing sheet 2 stiffens the replaceable poster sheet 4.

Sign frames 12, 14 are mounted to be partially supported by posts 13, 15 by post mounts 17, 19. As better seen in FIGS. 2, 3 each post mount 17, 19, in this embodiment, includes a cylindrical metal or plastic tube 21 with inner diameter greater than post 13 outer diameter. One or more threaded openings are provided in the reinforced tube side-wall to cooperate with one or more mounting bolts 23. To install, tube 21 is slipped over the top of post 13 to a desired vertical position above the supporting surface and bolts 23 tightened to clamp post 13 or 15 between the bolts distal ends and the upper surface of tube 21. Lock washers (not shown) can be used to secure the bolts as desired. This arrangement can accommodate various diameters for post 15.

Figure 6:
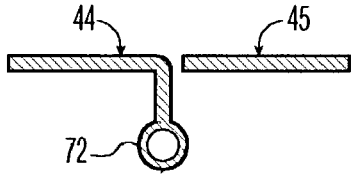
FIG. 6 is a horizontal section view taken along lines 66 of FIG. 5.
Figure 7:
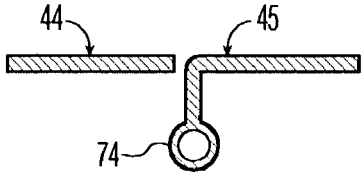
FIG. 7 is a horizontal section view taken along lines 66 of FIG. 5.

Post mount 17 also includes a laterally extending flange plate 25 welded, molded, or otherwise connected to tube 21. Flange plate 25 includes two or more vertically aligned openings to accommodate screws or bolts 29 that secures flange plate 25 to the respective frame side 24 and frame side stiffening bar 31. A laterally extending metal U-channel, L-channel, or box (shown) strengthening beam 27 serves to strengthen the sign assembly and resist impact and torque forces caused by wind, impact, etc. The left end of box beam or strengthening beam 27 is also welded or connected to flange plate 25. Strengthening beam 27 extends laterally to and is welded or otherwise connected to the opposite hinge plate 44 described below. It is preferred that the post-mount, strengthening beam, and hinge-mount be welded together as a single mounting assembly unit 60, 70 in FIG. 5. This makes handling and installation in the field more effective and efficient and reduces the number of parts to be connected in the field. In addition, assemblies 60, 70 can be identical with each other as can be better seen in FIGS. 5, 6, and 7. Note assembly 60 and 70 are identical, with assembly 70 rotated 180° in the plane of the drawing paper relative to assembly 60. A benefit of making assemblies 60, 70 identical includes reducing the unit manufacturing costs for these parts.

Hinge post assembly 40 includes a metal base plate 41 with bolt holes for mounting to the support surface, an outer plastic or metal support tube or hollow post 42 welded to or resting on base plate 41 and a hinge rod 43 threaded into and extending from the base plate 41 to suitably above the distal open top of tube 42. Advantageously, the top of tube 42 and one end of rod 43 can be cut at the installation site to select the optimum predetermined height of the hinge plates 44, 45 even if the supporting surface portion near post 13, 15 is not at the same level as the supporting surface portion near hinge post assembly 40. Each hinge plate 44, 45 includes a vertical piece 33 that overlies the respective side stiffening bar 31, which piece 33 defines two vertically aligned openings to accommodate mounting screws or bolts 49 that thread into the respective side frame or mounting pieces therein (not shown) to secure hinge plate 44, 45 to the side frames of respective sign assemblies. Hinge plate 44 (FIG. 5) includes a hinge 72 that installs over the distal end of rod 43 and lowers until plate 44 is supported by the top of tube 42. Hinge Plate 45 includes hinge 74 that also slides over the top of rod 43 until the plate 45 hinge 74 rests on plate 44 hinge 72. Nut 47 threads on to the threaded top end 46 of rod 43 to vertically secure the assembly. A lock washer or double nut arrangement (not shown) can be used as desired. Also, if desired, a nut or double nut fixed at the desired height on rod 43 can be used to support hinge-plate 44 or can be covered by the top of tube 42 to aid in the support of hinge-plate 44. Nevertheless, with bolt 23 loosened, plate 44, 45, and therefore, sign frames 12, 14 can rotate about rod 43 until all desired angular positions are set. Bolts 23 and nut 47 can be tightened to lock these angular positions. Bolts 48 can be installed then or at an earlier time, if desired.

Figure 8A:
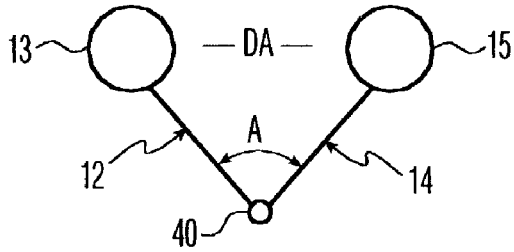
FIG. 8A is a schematic top view of FIG. 1.
Figure 8B:
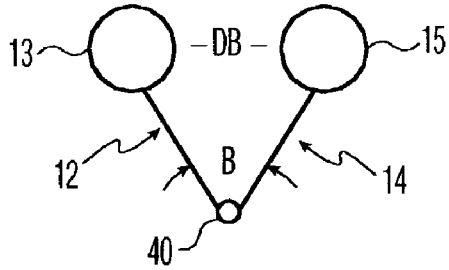
FIG. 8B is similar to FIG. 8A in which posts 13, 15 are closer together than in FIG. 8A.

One benefit provided by the present invention is that various sign assembly configurations can be employed with the use of parts made according to the principles of the present invention. For example, the two pre-installed posts, two-sign configuration of FIG. 1 is shown schematically in FIGS. 8A and B. Note the distance DA between posts 13, 15 in FIG. 8A is greater than the distance DB between posts 13, of FIG. 8B. Nevertheless, the same sign assembly mounts with the same elements in both figures by the installer simply selecting the angle "A" or "B" during installation and before bolts 23 and nut 47 are securely fastened. Accordingly, the number of parts needed to be stocked to install sign assemblies in the field on differently spaced posts is reduced to a minimum.

Figure 9:
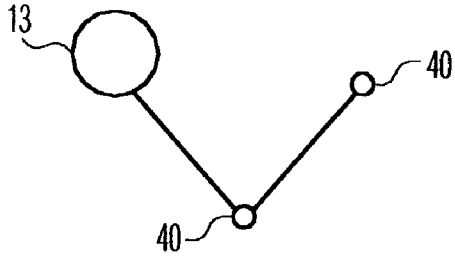
FIG. 9 is similar to FIG. 6 for an alternate embodiment having two signs and one pre-installed post.
Figure 10:
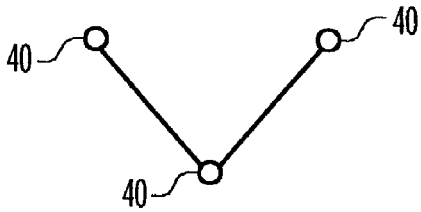
FIG. 10 is similar to FIG. 6 for a further alternate embodiment having two signs and three hinge post assemblies.
Figure 11:
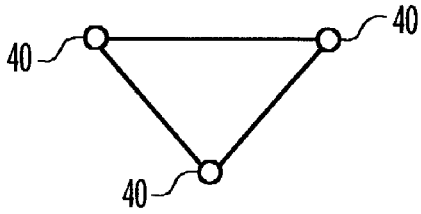
FIG. 11 is similar to FIG. 8 for an embodiment having three hinge posts assemblies and no pre-installed posts.
Figure 12:
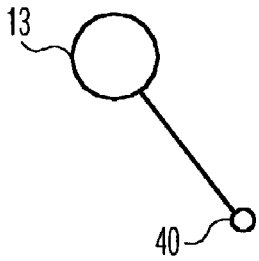
FIG. 12 is similar to FIG. 6 for an embodiment having one sign assembly and one pre-installed post.

A single pre-installed post 13, single sign configuration is shown in FIG. 12. FIG. 9 shows the schematic for a single pre-installed post and two signs using two hinge post assemblies 40. FIG. 10 shows a two-sign, three hinge post assemblies and no pre-installed post while FIG. 11 shows a three-sign and three hinge post assemblies. If one of the base plates 41 is left unsecured to the supporting surface, the sign frames of FIG. 11 can be rotated on respective hinge posts until all three sign frames are mounted on hinge posts at which time the triangular angles become fixed and the last base plate can be secured.

Figure 13:
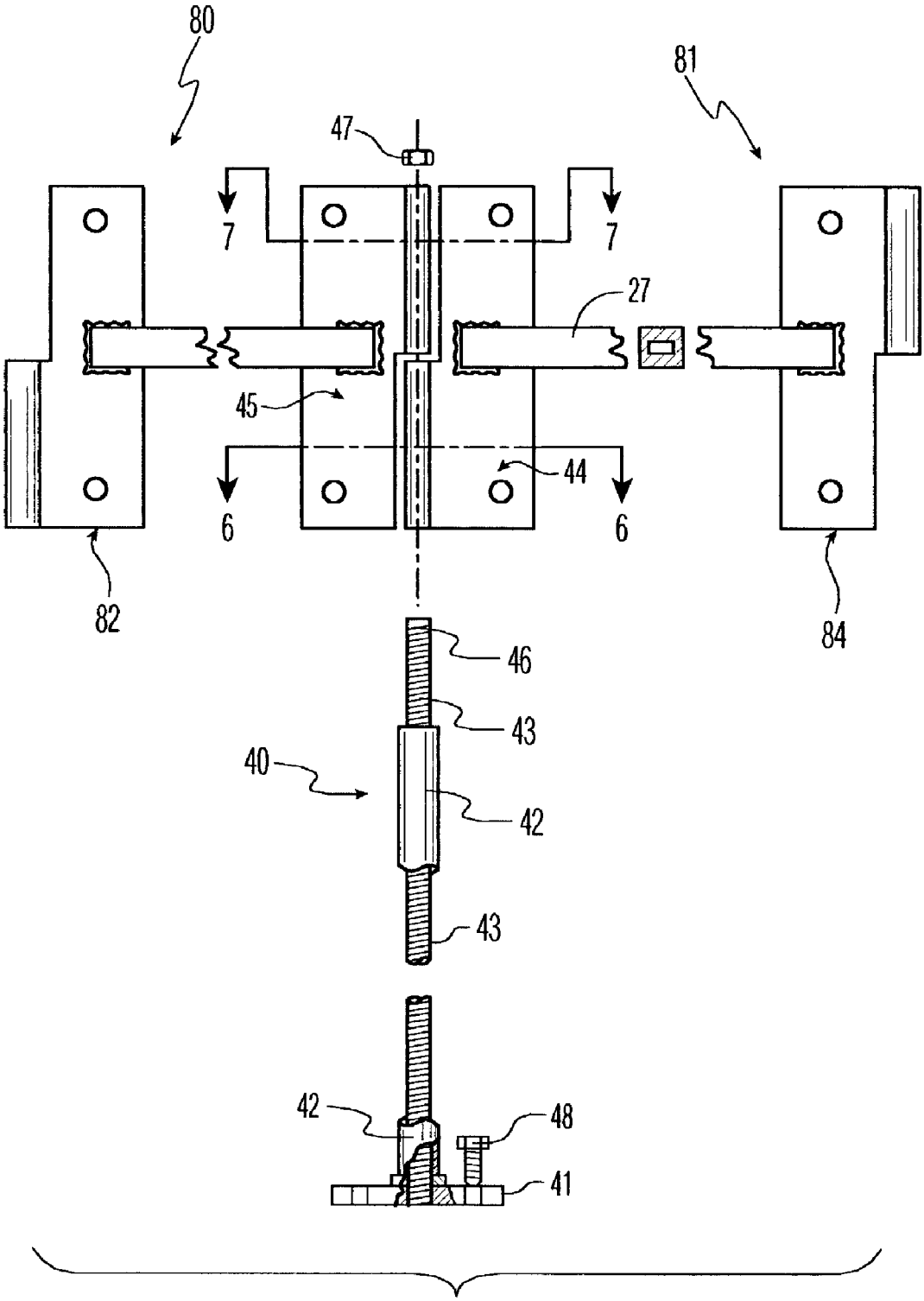
FIG. 13 is similar to FIG. 5 for a mounting assembly supported by three hinge rod assemblies.

For those configurations requiring a sign frame supported between two hinge-post assemblies 40, a mounting assembly with two hinge plates can be used instead of one hinge plate and one post mount. For example, for the configuration of FIG. 10, mounting assembly 80, 81 for each sign frame can be formed as shown in FIG. 13 wherein a hinge-plate 82, 84 is welded to each end of the strengthening beam generally as shown. Mounting assemblies 80, 81 are preferably identical. In the example of FIG. 13, assembly 81 is identical to assembly 80 but rotated 180° in the plane of the drawing paper.

It will be understood that various modifications and improvements can be made to the herein disclosed exemplary embodiments without departing from the spirit and scope of the present invention.

What is claimed is:

1. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, said first means comprising a first means plate securely coupled to said first side frame, a strengthening beam extending laterally and having one end connected to said first means plate and the other end connected to said plate portion, first and second stiffening bars securely coupled to the back side of and generally parallel with said first and second side frames, respectively, and wherein the first stiffening bar is positioned between the first means plate and its respective side frame and the second stiffening bar is positioned between said plate portion and its respective side frame.

2. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, said hinge support means including a tube member positioned around said hinge rod and having a tube top that contacts said hinge portion or an intermediate member positioned between said hinge portion and said tube top, and a retaining member releasably securable to the top of said rod for keeping said hinge portion mounted on said rod when said retaining member is positioned on the top of said rod.

3. A display sign assembly as set forth in claim 2, wherein said retaining member comprises a nut member and the top of the rod is threaded to receive said nut member.

4. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, said first means for supporting said first side frame including a post mount having a tubular portion for connection to a pre-installed post at a predetermined height above the supporting surface, and a first means plate connected to said tubular portion for being mounted to and supporting said first side frame, and said post mount further including securing means for securing said tubular portion to the pre-installed post at the predetermined angular position.

5. A display sign assembly as set forth in claim 4, wherein said securing means includes at least one bolt member extending through said tubular portion and having a distal end for engaging the pre-installed post to clamp the pre-installed post between said distal end and an inside surface of said tubular portion.

6. A display sign assembly as set forth in claim 5, wherein the angular position of the first side frame relative to the pre-installed post can be adjusted by rotating said tubular portion about the pre-installed post prior to said bolt member clamping the pre-installed post to the tubular member.

7. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, said first means for supporting said first side frame including a post mount having a tubular portion for connection to a pre-installed post at a predetermined height above the supporting surface, and a first means plate connected to said tubular portion for being mounted to and supporting said first side frame, a strengthening beam extending laterally and having one end connected to said first means plate and the other end connected to said plate portion.

8. A display sign assembly as set forth in claim 7, wherein said first and second side frames have back sides, the display sign assembly further comprising first and second stiffening bars securely coupled to the back sides of and generally parallel with said first and second side frames, respectively, and wherein the first stiffening bar is positioned between the first means plate and its respective side frame and the second stiffening bar is positioned between said plate portion and its respective side frame.

9. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, said first means for supporting said first side frame including a post mount having a tubular portion for connection to a pre-installed post at a predetermined height above the supporting surface, and a first means plate connected to said tubular portion for being mounted to and supporting said first side frame, said hinge support means including a tube member positioned around said hinge rod and having a tube top that supports a lower surface of said hinge portion or lower surface of an intermediate member positioned between said hinge portion and said tube top, Wherein said hinge rod includes a top, the display sign assembly further comprising a retaining member releasably securable to the top of said hinge rod for keeping said hinge portion mounted on said hinge rod when said retaining member is positioned on the top of said rod.

10. A display sign assembly as set forth in claim 9, wherein said retaining member comprises a nut member and the top of the hinge rod is threaded to receive said nut member.

11. A display sign assembly for supporting at least one display sign in a predetermined stationary position in relation to a supporting surface comprising:

at least one sign assembly with a generally rectangular sign frame having first and second side frames for releasably securing a sign sheet, first means for supporting said first side frame at a predetermined height above the supporting surface, for enabling angular rotation of said rectangular sign frame about a vertical axis, and for securing said rectangular sign frame at a predetermined angular position relative to the vertical axis, a hinge rod assembly for being supported by and in contact with the supporting surface having a hinge rod for being mounted upstanding at a predetermined location of the supporting surface, and a hinge plate having a hinge portion for installation on said hinge rod and a plate portion for being coupled to and supporting said second side frame, said hinge rod assembly further including hinge support means for supporting said hinge plate at a predetermined height above the supporting surface while enabling rotation of said hinge plate about said hinge rod before said side frame is secured in the stationary position at the predetermined angular position, a second generally rectangular sign frame having third and fourth side frames, second means for supporting said fourth side frame at a predetermined height above the supporting surface, a second hinge plate having a second hinge portion for installation on said hinge rod and a second plate portion for being coupled to and supporting said third side frame, said hinge support means for supporting said second hinge plate at a predetermined height above the supporting surface but enabling rotation of said second hinge plate about said hinge rod before the second sign assembly is secured in the stationary position, and a second strengthening beam extending laterally and having one end connected to said second plate and the other end connected to said second plate portion.

* * * * *